US007141280B2

(12) United States Patent
Schulz et al.

(10) Patent No.: US 7,141,280 B2
(45) **Date of Patent: *Nov. 28, 2006**

(54) MACROPOROUS INK RECEIVING MEDIA

(75) Inventors: Mark F. Schulz, Lake Elmo, MN (US); Omar Farooq, Woodbury, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/882,582

(22) Filed: Jul. 1, 2004

(65) Prior Publication Data

US 2004/0241349 A1 Dec. 2, 2004

Related U.S. Application Data

(62) Division of application No. 09/314,034, filed on May 18, 1999, now Pat. No. 6,773,769.

(51) Int. Cl.
*B41M 5/40* (2006.01)

(52) U.S. Cl. ..... 428/32.16; 428/32.18; 428/32.3; 428/32.34

(58) Field of Classification Search ..... 428/32.16, 428/32.18, 32.3, 32.34
See application file for complete search history.

(56) References Cited

U.S. PATENT DOCUMENTS

| | | | | |
|---|---|---|---|---|
| 2,583,548 | A | 1/1952 | Craig | |
| 4,174,223 | A | 11/1979 | Steen | |
| 4,419,388 | A | 12/1983 | Sugiyama et al. | |
| 4,649,064 | A * | 3/1987 | Jones | 427/256 |
| 4,732,786 | A | 3/1988 | Patterson et al. | |
| 4,740,420 | A | 4/1988 | Akutsu et al. | |
| 4,889,765 | A * | 12/1989 | Wallace | 442/71 |
| 4,954,395 | A * | 9/1990 | Hasegawa et al. | 428/32.24 |
| 5,027,131 | A | 6/1991 | Hasegawa et al. | |
| 5,126,010 | A | 6/1992 | Kobayashi et al. | |
| 5,192,363 | A | 3/1993 | Bussell et al. | |
| 5,429,860 | A | 7/1995 | Held et al. | |
| 5,537,137 | A | 7/1996 | Held et al. | |
| RE35,460 | E | 2/1997 | Klungness et al. | |
| 5,800,916 | A | 9/1998 | Yoshino et al. | |
| 5,807,364 | A | 9/1998 | Hansen | |
| 5,874,148 | A | 2/1999 | Hough et al. | |
| 5,958,547 | A | 9/1999 | Fukunishi et al. | |
| 6,096,418 | A | 8/2000 | Sato et al. | |
| 6,110,601 | A | 8/2000 | Shaw-Klein et al. | |
| 6,177,197 | B1 | 1/2001 | Imashiro et al. | |
| 6,206,517 | B1 * | 3/2001 | Kovacs et al. | 347/101 |
| 6,284,819 | B1 * | 9/2001 | Darsillo et al. | 524/22 |
| 6,326,075 | B1 | 12/2001 | Nagasaki et al. | |
| 6,350,507 | B1 | 2/2002 | Iwamoto et al. | |
| 6,394,597 | B1 | 5/2002 | Koike et al. | |
| 6,632,510 | B1 * | 10/2003 | Waller et al. | 347/105 |
| 6,703,112 | B1 * | 3/2004 | Farooq et al. | 428/195.1 |
| 6,773,769 | B1 * | 8/2004 | Schulz et al. | 428/32.16 |
| 6,841,208 | B1 * | 1/2005 | Farooq | 428/32.5 |
| 2002/0052439 | A1 * | 5/2002 | Farooq | 524/437 |

FOREIGN PATENT DOCUMENTS

| | | |
|---|---|---|
| EP | 0 842 786 A1 | 5/1998 |
| JP | 07 119047 | 5/1995 |
| WO | WO 95/28285 | 10/1995 |
| WO | WO 99/03685 | 1/1999 |
| WO | WO 99/06219 | 2/1999 |
| WO | WO 99/33669 | 7/1999 |

OTHER PUBLICATIONS

TYVEK Product Bulletin, retrieved from Dupont Website (http://www.dupont.com); site visited Sep. 24, 2001.

* cited by examiner

*Primary Examiner*—B. Shewareged

(57) ABSTRACT

The invention provides an ink receiving medium comprising a macroporous substrate having a fluid management system and having a pigment management system in contact with surfaces of macropores of the substrate therein. In one embodiment, the pigment management system comprises water-soluble multivalent metal salt and the fluid management system comprises surfactant.

7 Claims, No Drawings

MACROPOROUS INK RECEIVING MEDIA

CROSS REFERENCE TO RELATED APPLICATIONS

This application is a divisional of U.S. application Ser. No. 09/314,034, filed May 18, 1999, now U.S. Pat. No. 6,773,769, issued Aug. 10, 2004.

FIELD OF THE INVENTION

This invention relates to macroporous ink receiving media that provide durable high quality images with pigmented inks deposited thereon.

BACKGROUND OF THE INVENTION

Inkjet and spray jet printing using dye-based inks is one method of manufacturing printed porous substrates such as textiles. Printed dyes may be "fixed" with dye mordants to improve waterfastness. Inkjet printing is well-suited for, among other things, short printing run and high resolution applications.

Pigment-based inks are commonly applied to porous substrates such as textiles by screen-printing methods, and are typically more durable than dye-based inks. In order to retain the pigment on the textile, a binder resin is employed to provide a means for anchoring the pigment to the textile. Screen-printing inks have viscosities that far exceed the maximum viscosities that may be successfully printed by inkjet methods. Additionally, the binder resins used in screen inks generally lend a stiffer (i.e., aesthetically undesirable) hand to the textile than if the same textile had been dyed. Screen printing is not a technology well-suited to short run printing in that a considerable effort is required to change screens and/or ink colors.

Dye-based inks generally suffer from poor stability compared to pigment-based inks, especially when lightfastness and waterfastness are considered.

There exists a need to provide durable lightfast and waterfast articles that combine the advantages of lightfastness, waterfastness, soft hand, and high resolution.

SUMMARY OF THE INVENTION

One aspect of the present invention is an ink receiving medium comprising a macroporous substrate having a pigment management system and a fluid management system in contact with surfaces of macropores of the substrate therein.

Another aspect of the present invention is an ink receiving medium comprising a macroporous substrate impregnated with a composition comprising one or more water-soluble multivalent metal salts together with a surfactant or a combination of surfactants for the ink and substrate being employed.

Another aspect of the present invention is an ink receiving medium comprising a macroporous substrate having a pigment management system and an optional fluid management system wherein the pigment management system is a non-aqueous solvent soluble metal salt.

The novel ink receiving media when imaged using an inkjet printer provide durable, high color intensity and high quality images which are tack-free and rapidly dry to the touch.

In another aspect, the present invention provides an ink receiving medium/ink set comprising a macroporous substrate impregnated with one or more multivalent water-soluble metal salts and a surfactant or combination of surfactants, and an ink that contains pigment colorants.

The ink receiving media of the invention provide images having improved durability, waterfastness, smear resistance, rapid dry times, and long term durability using a macroporous substrate without absorptive polymeric binders, or additional processes such as UV exposure or heating.

In a preferred embodiment, the ink colorant is a pigment dispersion having a dispersant bound to the pigment that will destabilize, flocculate, agglomerate, or coagulate on contact with the ink receiving medium. Upon deposition of ink at or just below the surface of the macroporous substrate, the fluid management system wicks the ink into the fibers or macropores where the pigment management system fixes (i.e., immobilizes) the pigment.

A feature of the present invention is the ability to "fine tune" the properties of the ink receiving media of the present invention to deal with the variables of inkjet ink delivery, including without limitation: drop volume, ink surface tension, porosity of the ink receiving medium, and capacity of the ink receiving medium to receive ink.

Other features of ink receiving media of the invention include that they: are cost competitive, work with pigmented inks, have high resolution, have high color density, provide wide color gamut, are waterfast, are smudge resistant, and provide rapid drying.

An advantage of ink receiving media of the present invention is that a laminated protective cover layer is not necessary to achieve water resistant images.

Another advantage of ink receiving media of the present invention is the ability to use inexpensive readily available materials in printing processes to produce images on, for example, custom papers such as real or simulated ragstock, textile fabrics, spunbonded fiber media, melt-blown microfiber (i.e., BMF) media, polyethylene envelope mailers and the like.

Another advantage of ink receiving media of the present invention is very fast drying of the pigment and fluid management systems during coating or impregnation. The process saves significant amounts of energy and thus, reduces costs.

As used herein, a "macroporous substrate" means a substrate having an average pore size of from about 3 μm up to about 5 millimeters, preferably from about 10 μm to about 2 millimeters, more preferably from about 100 μm to about 0.5 millimeter and does not include microporous films and particles. In addition, the macroporous substrates of the invention are characterized by having a solidity of from at least about 1 percent up to about 90 percent, preferably from at least about 5 percent to about 70 percent, and even more preferably from at least about 10 percent up to about 50 percent.

As used herein, a "pigment management system" means a composition comprising a metal salt that has coated or impregnated a substrate to prepare an ink receiving medium suitable for use in the process of inkjet printing.

As used herein, a "fluid management system" means a composition comprising at least one surfactant that has coated or impregnated a substrate to prepare an ink receiving medium suitable for use in the process of inkjet printing.

The term "arithmetic median fiber diameter" means the fiber diameter for which equal numbers of fibers have diameters that lie above or below this value. The arithmetic median fiber diameter can be determined through microscopic examination.

The term "solidity" means the volume of fibers per volume of web. It is a unitless fraction typically represented by $\alpha$:

$$\alpha = \frac{m_f}{P_f L_f}$$

where $m_f$ is the fiber mass per sample surface area; $P_f$ is the fiber density; and $L_f$ is the macroporous substrate thickness. Solidity is used herein to refer to the macroporous substrate itself and not to any composite structure in which it may be included as a component thereof. When a macroporous substrate contains mixtures of two or more kinds of fibers, the individual solidities are determined for each kind of fiber using the same $L_f$. The individual solidities are added together to obtain the web's solidity, $\alpha_W$.

The term "average pore size" (also known as average pore diameter) is related to the arithmetic median fiber diameter and web solidity and can be determined by the following formula:

$$D = d_f\left\{\left(\frac{2\alpha_w}{\pi}\right)^{-1/2} - 1\right\}$$

where D is the average pore size, $d_f$ is the arithmetic median fiber diameter, and $\alpha_W$ is the web solidity.

DETAILED DESCRIPTION OF THE INVENTION

Macroporous substrates useful in the present invention include but are not limited to woven or nonwoven fabrics of natural fibers such as cotton, flax, hemp, wood pulp, ramie, burlap, wool, silk, etc.; synthetic fibers such as rayon, acrylic, polyolefin fibers such as polypropylene, polyethylene, or polyvinyl chloride; polystyrene and block copolymers thereof with butadiene such as those sold under the trade designation KRATON; polyester fibers such as polycaprolactone or polyethylene terephthalate fibers, and fibers sold under the trade designation DACRON; polyamide fibers such as polycaprolactam and polyhexamethyleneadipamide, (particularly including polyamide fibers sold under the trade designation NYLON); polyarylsulfones, poly(vinyl alcohol), poly(ethylene vinyl acetate), polyacrylates such as polymethyl methacrylate; polycarbonates; cellulosic polymers such as cellulose acetate butyrate; polyimides; polyurethanes, particularly including polyether polyurethanes; or blends thereof such as for example, rayon/polyester blends, polypropylene/polyethylene blends, polypropylene/polyethylene terephthalate blends, polypropylene/polyamide blends, or any combination thereof. The fibers may range in size from 0.01 to 50 denier (denier is the weight in grams of a fiber 9000 meters in length) or more and may be present as individual fibers or twisted into yarns.

Useful macroporous substrates also include virtually any type of melt-blown or spunbonded fibrous substrates and pulp or paper materials having the desirable mechanical strength and integrity.

Macroporous substrates of the invention can be of unlimited length, depending on the size of the roll that can be easily handled. Usually, commercial quantities of the macroporous substrate for feeding into a commercial printer can be a roll having a length in excess of 10 meters, and preferably in excess of 20 meters and may be as long as several kilometers. The macroporous substrate can have a width ranging from about 0.03 meters to about 10 meters or more.

The porosity, average pore size, surface energy, and caliper of the macroporous substrate can be selected to provide suitable fluid management for the image graphic. Therefore, depending upon the pigmented ink selected for imaging, the type of ink can determine the type of porous surface most suitable for wicking of fluid from the deposited image graphic into the pore volume of the substrate. However, according to the present invention, a wide latitude in porosity is generally acceptable.

Sometimes, the chemical and physical properties (e.g., surface energy) of the porous surface requires assistance from surfactants to aid in the management of ink fluids. Therefore, a fluid management system containing at least one surfactant may be advantageously impregnated into the pore volume of the macroporous substrate. Application of the fluid management system may be performed as a separate and distinct step, or combined with the pigment management system and coated onto the substrate in a single step, followed by removal of any water and/or organic solvent or solvents, to provide particularly suitable surfaces for the particular fluid components of the pigmented inkjet inks. Surfactants can be cationic, anionic, nonionic, or zwitterionic. Many of each type of surfactant are widely available to one skilled in the art. Accordingly, any surfactant or combination of surfactants or less preferably, polymer(s) that will render said substrate hydrophilic, could be employed.

These may include but are not limited to fluorochemical, silicone and hydrocarbon-based surfactants wherein the said surfactants may be anionic or non-ionic. Furthermore, the non-ionic surfactant may be used either as it is or in combination with another anionic surfactant in water and/or organic solvent or solvents, said organic solvent being selected from the group consisting of alcohols, ethers, amides, ketones, and the like.

Various types of non-ionic surfactants can be used, including but not limited to: ZONYL fluorocarbons (e.g., ZONYL FSO, available from E.I. du Pont de Nemours and Co. of Wilmington, Del.); FLUORAD FC-170 or 171 surfactants (available from Minnesota Mining and Manufacturing Company (3M) of St. Paul, Minn.); PLURONIC block copolymers of ethylene and propylene oxide to an ethylene glycol base (available from BASF Corp. Chemicals Division of Mount Olive, N.J.); TWEEN polyoxyethylene sorbitan fatty acid esters (available from ICI Americas, Inc. of Wilmington, Del.); TRITON X series octylphenoxy polyethoxy ethanol (available from Rohm and Haas Co. of Philadelphia, Pa.); SURFYNOL tetramethyl decynediol (available from Air Products and Chemicals, Inc. of Allentown, Pa.); and SILWET L-7614 and L-7607 silicon surfactants (available from Union Carbide Corp. of Danbury, Conn.), and the like known to those skilled in the art.

Useful anionic surfactants include, but are not limited to, alkali metal and (alkyl)ammonium salts of: 1) alkyl sulfates and sulfonates such as sodium dodecyl sulfate and potassium dodecanesulfonate; 2) sulfates of polyethoxylated derivatives of straight or branched chain aliphatic alcohols and carboxylic acids; 3) alkylbenzene or alkylnaphthalene sulfonates and sulfates such as sodium laurylbenzene-sulfonate; 4) ethoxylated and polyethoxylated alkyl and aralkyl alcohol carboxylates; 5) glycinates such as alkyl sarcosinates and alkyl glycinates; 6) sulfosuccinates including dialkyl sulfosuccinates; 7) isethionate derivatives; 8)

N-acyltaurine derivatives such as sodium N-methyl-N-oleyltaurate); 9) amphoteric alkyl carboxylates such as amphoteric propionates and alkyl and aryl betaines, optionally substituted with oxygen, nitrogen and/or sulfur atoms; and 10) alkyl phosphate mono or di-esters such as ethoxylated dodecyl alcohol phosphate ester, sodium salt.

Useful cationic surfactants include alkylammonium salts having the formula $C_nH_{2n+1}N(CH_3)_3X$, where X is OH, Cl, Br, $HSO_4$ or a combination of OH and Cl, and where n is an integer from 8 to 22, and the formula $C_nH_{2n+1}N(C_2H_5)_3X$, where n is an integer from 12 to 18; gemini surfactants, for example those having the formula: $[C_{16}H_{33}N(CH_3)_2C_mH_{2m+1}]X$, wherein m is an integer from 2 to 12 and X is as defined above; aralkylammonium salts such as, for example, benzalkonium salts; and cetylethylpiperidinium salts, for example, $C_{16}H_{33}N(C_2H_5)(C_5H_{10})X$, wherein X is as defined above.

The macroporous ink receiving media of the invention have a pigment management system prepared by addition of a solution containing at least one multivalent metal salt into the pore volume of the macroporous substrate and removal of the solvent. The multivalent metal salts are believed to serve as reagents to rapidly destabilize dispersants surrounding the pigment particles in the ink, whereby the pigment particles coagulate or flocculate as the remainder of the ink fluid continues through pores and along the surfaces of the ink receiving medium. The multivalent salts therefore provide a chemical means of pigment management along surfaces of the pores. The salts coat the surfaces of the macroporous substrate and, once dried, are resistant to physical removal. The metal salts are soluble in water for both preparing solutions and during imaging, but not after complexing with the dispersing aid that surrounds the pigment particles in the ink (i.e., the printed image is waterfast).

Non-limiting examples of multivalent metal salts useful in the present invention include the metal cations from Group IIA and above in the Periodic Table, such as Ca, Mg, Ti, Zr, Fe, Cu, Zn, Ta, Al, Ga, Sn, with counter ions such as sulfate, nitrate, bisulfate, chloride; aromatic carboxylates such as benzoates, naphthalates, phthalates, etc.; sulfocarboxylates, sulfophthalates, and the like.

Specific examples of preferred multivalent metal salts include aluminum sulfate, aluminum nitrate, gallium nitrate, ferrous sulfate, chromium sulfate, zirconium sulfate, magnesium sulfophthalate, copper sulfophthalate, zirconium sulfophthalate, zirconium phthalate, zinc sulfate, zinc acetate, zinc chloride, calcium chloride, calcium bromide, magnesium sulfate, magnesium chloride, aluminum sulfophthalate, aluminum sulfoisophthalate, and combinations thereof. These compounds are typically sold and can be used in the hydrated form. Of the various possible salts, aluminum sulfate and aluminum sulfophthalate are presently preferred.

The amount of salts that can be used in the coating solution for imbibing in the porous substrate of the present invention can range from about 0.1 weight percent to about 50 weight percent, and preferably from about 0.5 weight percent to about 20 weight percent.

The amount of surfactant that can be used in the coating solution for imbibing in the porous substrate of the present invention can range from about 0.01 weight percent to about 10 weight percent, and preferably from about 0.1 weight percent to about 5 weight percent.

Optionally, heat or ultraviolet light stabilizers can be used in ink receptors of the present invention. Non-limiting examples of such additives include TINUVIN 123 or 622LD, or CHIMASSORB 944 (hindered amine light stabilizers, available from Ciba Specialty Chemicals Corp. of Tarrytown, N.Y.), and UVINUL 3008 (available from BASF Corporation Chemicals Division of Mount Olive, N.J.). Such stabilizers can be present in a coating solution to be impregnated into the macroporous substrate in the range from about 0.2 weight percent to about 20 weight percent. Preferably, the stabilizer is present in an amount from about 0.1 to about 10 weight percent, more preferably in an amount of from about 0.5 to about 5 weight percent.

Optionally, ultraviolet light absorbers can be used in ink receiving media of the present invention. Non-limiting examples of such absorbers include TINUVIN II 30 or 326 (available from Ciba Specialty Chemicals Corp.), UVINUL 40501 1 (available from BASF Corporation), and SANDUVOR VSU or 3035 (available from Sandoz Chemicals of Charlotte, N.C.). Such absorbers can be present in the coating solution and can range from about 0.01 weight percent to about 20 weight percent. Preferably, the absorber is present in an amount from about 1 to about 10 weight percent.

Optionally, anti-oxidants can be used in ink receiving media of the present invention. Non-limiting examples of such anti-oxidants include IRGANOX 1010 or 1076 (available from Ciba Specialty Chemicals Corp.), VINUL 2003 AD (available from BASF Corporation Chemicals Division).

Such anti-oxidants can be present in the coating solution and can range from about 0.2 weight percent to about 20 weight percent. Preferably, the anti-oxidant is present in an amount from about 0.4 to about 10 weight percent, and more preferably in an amount from about 0.5 to about 5 weight percent.

Optionally, opacifying pigments can be used in ink receiving media of the present invention. Non-limiting examples of such opacifying pigments include titanium dioxide pigments, barium sulfate pigments, and the like. Such opacifying pigments can be present in the coating solution and can range from about 0.01 weight percent to about 50 weight percent. Preferably, the opacifying pigment is present in an amount from about 1 to about 30 weight percent.

Optionally, organic binders can be used in the ink receiving media of the invention. The organic binders are used to bind opacifying pigments and/or other additives onto the macroporous substrate. Preferably, the organic binders are soluble or dispersible in water so that they may be easily incorporated into the compositions used to coat macroporous substrates in forming the ink receiving media of the invention. Non-limiting examples of such organic binders include acrylic emulsions, styrene-acrylic emulsions, poly vinylalcohol and the like. Such organic binders can be present in the coating solution from about 0.1 to about 50 weight percent, preferably about 1 to about 30 weight percent based on total weight of the coating solution, including surfactants and metal salts, with the remainder being water and/or organic solvent.

An ink receiving medium of the present invention has two major opposing surfaces and can be employed for printing (for example, by inkjet methods) on both surfaces. Optionally, one of the major surfaces can be dedicated for the purpose of adhering the finished image graphic to a supporting surface such as a wall, a floor, or a ceiling of a building, a sidewall of a truck, a billboard, or any other location where an excellent quality image graphic can be displayed for education, entertainment, or information.

Minnesota Mining and Manufacturing Company (3M) offers a variety of image graphic receptor media and has developed an array of pressure-sensitive adhesive formulations that can be employed on the major surface opposing the surface intended for imaging. Among these adhesives are those disclosed in U.S. Pat. No. 5,141,790 (Calhoun et al.); U.S. Pat. No. 5,229,207 (Paquette et al.); U.S. Pat. No. 5,800,919 (Peacock et al.); U.S. Pat. No. 5,296,277 (Wilson et al.); U.S. Pat. No. 5,362,516 (Wilson et al.); EPO Patent Publication EP 0 570 515 B1 (Steelman et al.), and co-pending, co-assigned U.S. patent application Ser. No. 08/775,844 (Sher et al.) and Ser. No. 08/664,730 (Peloquin et al.).

Any of these adhesive surfaces should be protected by a release or storage liner such as those commercially available from Rexam Release of Bedford Park, Ill. Alternatively to adhesives, mechanical fasteners can be used if laminated in some known manner to that opposing major surface of the receptor of the present invention. Non-limiting examples of mechanical fasteners include hook and loop, Velcro™, Scotchmate™ and Dual Lock™ fastening systems, as disclosed in published PCT Patent Application No. WO 98/39759 (Loncar), the disclosures of which are incorporated by reference herein.

While the imaging major surface is not covered before imaging, after imaging, an optional layer may be applied to that imaged surface of the ink receiving medium to protect and enhance the image quality of the image on the receptor. Non-limiting examples of optional layers are overlaminates and protective clear coatings commercially available from Minnesota Mining and Manufacturing Company (3M) from its Commercial Graphics Division and those disclosed in U.S. Pat. No. 5,681,660 (Bull et al.), the disclosure of which is incorporated by reference herein. Other products known to those skilled in the art can also be used.

The invention in its preferred mode is made by impregnation of the macroporous substrate with a pigment management system composition (i.e., a solution containing one or more multivalent metal salts) and with a suitable fluid management system (i.e., one or more surfactants) as required followed by drying at a temperature of about 100 to about 120° C. After the receptor is dried, it can be imaged using conventional inkjet imaging techniques embodied in commercially available printers.

Impregnation of the pigment management system and/or fluid management system may be accomplished by dissolving or mixing the salt and/or surfactant in de-ionized water or a mixture of an alcohol and de-ionized water. Impregnation of the solution may be done using conventional equipment and techniques such as slot fed knife, rotogravure devices, padding operations, dipping, spraying, and the like. It is preferred that the pigment management system fills the pores of the substrate without leaving substantial quantities on the surface. Excessive amounts of solids could plug the pores and in turn causes smearing and slow dry times during imaging. Coating weights depend on porosity, thickness, and chemical nature of the substrate, but may be readily determined by routine optimization. Typical wet coating weights are from about 1 up to about 500 grams per square meter, preferably from about 10 up to about 50 grams per square meter, more preferably from about 15 to about 30 grams per square meter. Optional additives may be added before, during, or after impregnation of the pigment management system and/or fluid management system.

The printing industry has previously employed dye-based inks, although pigment-based inks are becoming more prevalent. Use of pigment colorants is preferred over dye colorants because of durability and ultraviolet light stability in outdoor applications.

Further, reference to ink with respect to this invention concerns aqueous-based inks, not solvent-based inks. Aqueous-based inks are currently preferred in the printing industry for environmental and health reasons, among other reasons.

Minnesota Mining and Manufacturing Company (3M) produces a number of excellent pigmented inkjet inks for thermal inkjet printers. Among these products are Series 8551, 8552, 8553, and 8554 pigmented inkjet inks. The use of four principal colors: cyan, magenta, yellow, and black permit the formation of as many as 256 colors or more in the digital image. Further, pigmented inkjet inks, and components for them, are also produced by others, including Hewlett-Packard Corp. of Palo Alto, Calif. and E.I. du Pont de Nemours and Co., and a number of other companies that can be located at many commercial trade shows dedicated to the imaging and signage industries.

The ink receiving media of the present invention are highly fluid absorptive media. Some of the macroporous receptors are opaque because of their inherent light scattering ability while some are light transmissive. Using opaque backing support, the receptor can be used for reflective mode applications. The ink receiving media of the invention can be used as banners, signage, murals, art media, gallery display, trade show display, and the like. Because they are substantially waterfast, the receptor media of the invention can be used outdoors as well as indoors.

When the ink receiving media of the invention are imaged in DESIGN JET 2500 CP, DESIGN JET 3500 CP series (available from Hewlett-Packard Corp.) or Encad NOVAJET (available from Encad Inc. of San Diego, Calif.) wide-format printers using pigmented inks, it results in images with excellent quality with high color density which rapidly dry to the touch.

The advantages and unexpected results of the receptor media of the invention will now be demonstrated in the following examples.

EXAMPLES

All of the amounts given are in weight percent unless otherwise stated. Unless otherwise stated, all of the components are available from Aldrich Chemical Co., Milwaukee, Wis.

The wet rub test used in the examples was performed as follows: Water was placed on a portion of the printed image, and then rubbed with a thumb using light to moderate pressure. If the image did not smear, then the test was judged a pass. If smearing occurred, then the test was judged a fail.

As used in these examples, rapidly dry to the touch means that the image emerged from the printer sufficiently dry such that no ink transfer from the printed image occurred when contacted by a lightly applied dry finger.

The NOVAJET 4 wide format ink jet printer employed in the examples was obtained from Encad, Inc., using yellow, magenta, cyan, and black pigmented inks (Series 8551–8554, obtained from Minnesota Mining and Manufacturing Company (3M)).

The wide-format inkjet printers DESIGN JET 2500 CP and DESIGN JET 3500 CP were obtained from Hewlett-Packard Comp., Inc. and were used with yellow, magenta, cyan, and black pigmented inks (Cartridge Nos. C1892A, C1893A, C1894A, and/or C1895A, available from Hewlett-Packard).

ELEVES T0703WDO spunbonded polyethylene/polyester non-woven fabric (70 g/m$^2$ basis weight, 0.25 millimeter thickness), was obtained from Unitika Ltd. of Tokyo, Japan.

REEMAY 2033 spunbonded polyester (100 g/m$^2$ basis weight, 0.44 millimeter thickness), was obtained from Reemay, Inc. of Old Hickory, Tenn.

Examples 1–5 and 10–13 use Composition A prepared by mixing the components described below in Table 1.

TABLE 1

| Components | Weight Percent |
|---|---|
| Aluminum Sulfate, Hydrated | 5.2 |
| Dioctyl sulfosuccinate, sodium salt (DOS) | 6.0 |
| Isopropyl Alcohol | 25.0 |
| De-ionized Water | 63.8 |

Example 1

A 30.5 centimeters×25.4 centimeters piece of non-woven/fibrous polypropylene film (MIRACLOTH brand, available from Calbiochem, LaJolla, Calif.) was dipped into Composition A and then dried with a heat-gun (110–120° C.) for about 2 minutes. The dry fabric was laminated with a pressure-sensitive adhesive onto a transparent polyester sheet and then imaged using a NOVAJET 4 printer to obtain a bleed-free, feather-free, high density, and tack-free rapidly dry image. Imaging was accomplished using yellow, magenta, cyan, and black inks. On wet-rub, there was slight movement in the cyan color but no movement in any of the other colors. On dipping into water or subjecting the image to running water, there was no mobility of any color.

Comparative Example 1

A virgin non-woven polypropylene substrate was printed with the same image as described in Example 1. Comparative Example 1 showed an uneven image with high bleeding, feathering, and the image washed away when placed under running tap water.

Example 2

Example 2 was prepared as described in Example 1 above, except that the printable substrate was melt-blown non-woven polypropylene fabric, using 3505G polypropylene, available from Exxon Chemicals of Houston, Tex., having an average fiber diameter of 7 μm and a basis weight of 40 g/m$^2$ and a thickness of 0.54 millimeter to obtain an image with similar characteristics and properties, including waterfastness to those obtained in Example 1.

Example 3

Example 3 was prepared as in Example 1 except that the printable substrate was non-woven polyester fabric made using a melt-blown process with polyethylene terephthalate resin (Mw 44,000; Mn 19,000), to make fibers having an average fiber diameter of 17 μm, and a basis weight of 100 g/m$^2$ and the laminated substrate was spunbonded polyester. The laminated fabric was then impregnated with Composition A, dried with a heat-gun (110–120° C.) for about 2–3 minutes and then imaged with a DESIGN JET 2500 CP printer to obtain a bleed-free, feather-free, tack-free, and rapidly dry image. On wet-rub, there was slight movement in the cyan but no movement in any of the other colors. On dipping into water or subjecting it to running water, there was no mobility of any of the color.

Comparative Example 2

A non-coated non-woven blown microfiber polyester fabric was printed as described in Example 3 provided an image that washes away when exposed to running or stationary water.

Example 4

This example demonstrates impregnation of aluminum sulfate compositions into a piece of woven polyester fabric, TX-1012 (Alpha-10, 100 percent continuous filament polyester, available from Texwipe Co. of Upper Saddle River, N.J.). A piece of non-woven polyester fiber was dipped into Composition A (Table 1) and then was dried with a heat-gun as described in Example 3. The impregnated fabric was then laminated onto a spunbonded polyester (Unitika Ltd. of Tokyo, Japan) backing using a pressure-sensitive adhesive. When imaged using a DESIGN JET 2500 CP, DESIGN JET 3500 CP or NOVAJET 4 printer a bleed-free, feather-free, tack-free, high color density rapidly dry image with sharp and bright edges was obtained. On wet-rub, there was slight movement in the cyan color. On dipping into water or subjecting it to running water, there was no mobility of any color.

Comparative Example 3

A non-coated piece of the fabric used in Example 4 was printed as described in Example 4 and provided an image that bled, feathered, and washed away when exposed to running or stationary water.

Example 5

A piece of polyethylene spunbonded material (TYVEK™, E.I. du Pont de Nemours) was flood-coated with Composition A (Table 1) using a Mayer rod #4 (available from R & D Specialties, Inc. of Whittier, Calif.). The impregnated substrate was dried with a heat-gun as described in Example 4. The ink receiving medium provided good imaging and density, with some feathering and smudging when imaged with a NOVAJET 4 printer. The ink receiving medium provided good imaging and density, with some feathering when imaged in a DESIGN JET 2500 CP or DESIGN JET 3500 CP printer.

Example 6

A spunbonded polyethylene/polyester non-woven fabric (ELEVES T0703WDO) was coated with a pigment management system containing 5 percent aluminum sulfate and 0.5 percent dioctyl sulfosuccinate, sodium salt (DOS) surfactant in water, followed by drying off the water in an oven at 100° C. This substrate was printed using a DESIGN JET 2500 CP printer. The image exhibited high color density, no bleed or feathering between colors (i.e., sharp edges), and uniform coloration. Running the image under tap water did not noticeably remove any colorants. This image was soaked in water overnight without an appreciable change in the image quality.

Comparative Example 4

A non-coated sample of spunbonded polyethylene/polyester non-woven fabric (ELEVES T0703WDO) was printed as in Example 6. The image showed relatively low color density, severe ink bleed, ink feathering between colors (i.e., non-sharp edges), and non-uniform coloration. When the non-coated substrate was run under tap water for about 1 second, the colorants were readily removed.

Comparative Example 5

A sample of spunbonded polyethylene/polyester non-woven fabric (ELEVES T0703WDO) was coated with a solution of 0.5 percent DOS surfactant in water, followed by drying off the water in an oven at 100° C. This substrate was then printed as in Example 6. The image and waterfastness properties were similar to those observed in Comparative Example 4.

Example 7

An ink receiving medium was made as in Example 6, except spunbonded polyester (REEMAY 2033) was used as the non-woven fabric. The substrate was printed as in Example 6. Excellent image quality and waterfastness was provided as in Example 6.

Comparative Example 6

A non-coated sample of spunbonded polyester non-woven fabric (REEMAY 2033), was printed as in Example 7. The image showed relatively low color density, severe ink bleed, ink feathering between colors (i.e., non-sharp edges), and non-uniform coloration. When the non-coated substrate was run under tap water for about 1 second, the colorants were readily removed.

Comparative Example 7

A sample of spunbonded polyester non-woven fabric (REEMAY 2033) was coated with a solution of 0.5 percent DOS surfactant in water, followed by drying off the water in an oven at 100° C. It was then printed as in Example 7. The image and waterfastness properties were similar to those observed in Comparative Example 6.

Example 8

An ink receiving medium was made as in Example 7, except that a pigment management system composition containing 0.5 percent aluminum sulfate and 0.5 percent DOS in water was used. The resulting image provided similarly excellent image quality and waterfastness as in Example 6.

Example 9

An ink receiving medium was made as in Example 6, except that a pigment management system composition containing 1.4 percent aluminum sulfate, 0.14 percent DOS, 22 percent $TiO_2$ pigment, and 25 percent (RHOPLEX™ B-60A, obtained from Rohm and Haas Co.) in water. The resulting image exhibited excellent image quality, waterfastness, and enhanced opacity for reflected viewing.

Example 10

A piece of paper (CASCADE X-9000, obtained from Boise Cascade Papers of Portland, Oreg.) was flood-coated with Composition A (Table 1) using a Mayer rod #4 and was allowed to dry at room temperature. The paper receptor was then briefly dried with a heat-gun (110–120° C.) for about 1 minute. When imaged using a DESIGN JET 2500 CP printer, there was obtained a bleed-free, feather-free, rapidly dry image which showed some cockling. On wet-rub, there was some movement of all the colors. On dipping into water, there was no mobility of any of the color.

Example 11

Composition A (Table 1) was coated onto a thick artist's paper (coarse paper) to obtain cockle-free, high density, and high quality dry image with waterfastness as described in Example 10.

Example 12

Coating of Composition A (Table 1) was repeated onto a Whatman #54 filter paper by flood-coating procedure. The dry film when imaged using a NOVAJET 4 printer gave a cockle-free, high density, high quality, smudge-free, dry image, which was waterfast.

Example 13

Coating of Composition A (Table 1) was repeated in a piece of file-folder paper (thick, coarse off-white paper). The dry film when imaged using a NOVAJET 4 printer gave a cockle-free, high density, high quality, smudge-free, dry image that was waterfast.

What is claimed is:

1. An imaged ink receiving medium comprising a macroporous substrate having a fluid management system comprising a surfactant and having a pigment management system comprising a water-soluble multivalent metal salt selected from the group consisting of aluminum sulfophthalate, aluminum sulfoisophthalate, magnesium sulfophthalate, copper sulfophthalate, zirconium sulfophthalate, zirconium phthalate, and combinations thereof in contact with surfaces of macropores of the substrate therein and having ink colorant fixed thereon, wherein the macroporous substrate has an average pore size of from about 3 micrometers to about 5 millimeters.

2. The imaged receiving medium of claim 1 wherein said image is waterfast.

3. The imaged receiving medium according to claim 1 wherein said surfactant is non-ionic, cationic, anionic, or a combination of anionic and non-ionic surfactants.

4. The imaged receiving medium according to claim 1 wherein said surfactant is selected from fluorochemical, silicone and hydrocarbon based surfactants, and combinations thereof.

5. The imaged receiving medium according to claim 1 wherein the pigment management system further comprises an opacifying pigment.

6. The imaged receiving medium according to claim 1 wherein the fluid management system comprises a hydrocarbon based anionic surfactant.

7. The imaged receiving medium according to claim 1 wherein said surfactant comprises sodium salt of dioctyl sulfosuccinate.

* * * * *

UNITED STATES PATENT AND TRADEMARK OFFICE

CERTIFICATE OF CORRECTION

PATENT NO. : 7,141,280 B2
APPLICATION NO. : 10/882582
DATED : November 28, 2006
INVENTOR(S) : Mark F. Schulz It is certified that error appears in the above-identified patent and that said Letters Patent is hereby corrected as shown below:

Title page,
Item (56), References Cited, U.S. PATENT DOCUMENTS, Col. 2, delete "6,841,208 B1 *" and insert in place thereof -- 6,841,208 B2 * --.

Column 6,
Line 23, delete "VINUL" and insert in place thereof -- UVINUL --.

Signed and Sealed this

Twenty-seventh Day of March, 2007

JON W. DUDAS
*Director of the United States Patent and Trademark Office*